US009540869B2

(12) United States Patent
Zhang

(10) Patent No.: US 9,540,869 B2
(45) Date of Patent: Jan. 10, 2017

(54) HOLLOW GLASS BUILT-IN SUN-SHADING APPARATUS

(75) Inventor: Xuezhong Zhang, Shanghai (CN)

(73) Assignee: Intigral, Inc., Walton Hills, OH (US)

( * ) Notice: Subject to any disclaimer, the term of this patent is extended or adjusted under 35 U.S.C. 154(b) by 0 days.

(21) Appl. No.: 14/415,653

(22) PCT Filed: Jul. 24, 2012

(86) PCT No.: PCT/CN2012/000992

§ 371 (c)(1),
(2), (4) Date: Jun. 15, 2015

(87) PCT Pub. No.: WO2014/012193

PCT Pub. Date: Jan. 23, 2014

(65) Prior Publication Data

US 2015/0300081 A1 Oct. 22, 2015

(30) Foreign Application Priority Data

Jul. 17, 2012 (CN) ..... 2012 1 0246022

(51) Int. Cl.
*E06B 9/264* (2006.01)
*E06B 9/262* (2006.01)
(Continued)

(52) U.S. Cl.
CPC ..... *E06B 9/264* (2013.01); *E06B 9/262* (2013.01); *E06B 9/322* (2013.01); *E06B 9/38* (2013.01);
(Continued)

(58) Field of Classification Search
CPC ..... E06B 9/264; E06B 9/384; E06B 9/382; E06B 9/322; E06B 9/38; E06B 9/262; E06B 2009/2643; E06B 2009/2646
(Continued)

(56) References Cited

U.S. PATENT DOCUMENTS 6,179,035 B1 * 1/2001 Anderson ..... E06B 9/303 160/168.1 R
8,616,260 B2 * 12/2013 Zhang ..... E06B 9/264 160/107
2004/0211528 A1 * 10/2004 Jin ..... E06B 9/264 160/107

* cited by examiner

*Primary Examiner* — Blair M Johnson
(74) *Attorney, Agent, or Firm* — McDonald Hopkins LLC

(57) ABSTRACT

The present invention relates to a built-in sun-shading device of hollow glass. The built-in sun-shading device comprises a cord-winding mechanism, a transmission mechanism controlling the rotation of the cord-winding mechanism and a sun-shading mechanism connected onto the cord-winding mechanism. The cord-winding mechanism comprises a cord-winding shaft, a group of cord-winding propellers are arranged on the cord-winding shaft, the transmission mechanism is connected with the cord-winding mechanism, and the sun-shading mechanism is connected onto the cord-winding propellers. The built-in sun-shading device of the hollow glass, which uses a single cord-winding shaft, can wind a plurality of cords and enable the sun-shading mechanism to be folded and unfolded in a balanced mode. The single cord-winding shaft does not need to move back and forth, is simple in terms of structure and has high assembling efficiency. In addition, the built-in sun-shading device of the hollow glass uses the cords to limit slats from moving to and fro, which thus enables the slats to stack up orderly, reduces contact between the slats and hollow glass, protects the coating film on the surface of the hollow glass and reduces friction. Furthermore, the built-in sun-shading device of the hollow glass uses a handle with frictional damping in one direction and overcomes a phenomenon that the large sun-shading mechanism may easily decline itself due to the large self-weight after being lifted.

9 Claims, 6 Drawing Sheets

(51) Int. Cl.

| | |
|---|---|
| ***E06B 9/38*** | (2006.01) |
| ***E06B 9/322*** | (2006.01) |
| ***E06B 9/382*** | (2006.01) |
| ***E06B 9/384*** | (2006.01) |

(52) U.S. Cl.
CPC ..... *E06B 9/382* (2013.01); *E06B 9/384* (2013.01); *E06B 2009/2643* (2013.01); *E06B 2009/2646* (2013.01)

(58) Field of Classification Search
USPC ..... 160/107
See application file for complete search history.

HOLLOW GLASS BUILT-IN SUN-SHADING APPARATUS

FIELD OF THE INVENTION

The present invention relates to a curtain, particularly, a built-in sun-shading device of hollow glass.

BACKGROUND OF THE INVENTION

Owing to excellent insulating and sun-shading effects, the pleated blinds of hollow glass become increasingly important in the modern construction in terms of energy efficiency; the blinds or pleated blinds of hollow glass have gradually been put into various applications, since blinds or pleated blinds of hollow glass are easy to clean, durable, fire-resistance and have special decorative effects. However, the blinds or pleated blinds of hollow glass currently in the market are all reduced to some drawbacks. Take the insulated glass blind assembly disclosed in U.S. Pat. No. 6,601,633B2 as an example. There, the blind cord is pulled downward under the magnetic force to raise the slats; once the cord is let go upward, the slats go downward under the gravity effect. In such a design, the several strands of cords can easily become tangled, making the blinds completely inoperable or making the lower frame of the blinds slid. In the U.S. Pat. No. 5,908,062, the lifting track of curtain makes use of two or more cord-winding shafts having a tapered cylindrical body; when the cord-winding shafts are operated to turn, two or more cords are wound orderly from the larger diametrical end to the smaller diametrical end, the curtain is lifted; when the cord-winding shafts are operated to turn in opposite direction, the curtain is lowered. However, in reality, such a device may face the problem that the curtain becomes slid as a result of cords being stuck between the cord-winding shaft and the end cap of the cord-winding shaft, or cords going up at varied speeds arising from difference between the exterior diameters of the cord-winding shafts. In the U.S. Pat. No. 6,817,401B2, the window blind assembly comprises a rotatable rod capable of simultaneously winding a plurality of cords; for the purpose of orderly winding, the rotatable rod needs to move back and forth, which nevertheless increases mechanical complexity and results lower efficacy in manufacturing and assembling.

Additionally, the width of the slats of the blinds is smaller than the spacing distance inside the hollow glass, such that the blinds can go up and down freely. However, when lifted up, the stack of slats of the blinds may be out of synch so as to result in collision with glass on two sides. In this case, friction would increase when the slats moves upward and downward, then the blind cannot be operated easily; meanwhile, the friction between the slats and the glass may cause scratches on the coating on the surface of the glass. In case of a large blind, the magnetic attract would be inadequate to raise or lower the blinds smoothly, or even the blinds can be raised up to the header position, the blind would be unable to retain at a desired position, because it may probably automatically drop down for a certain height under its weight.

SUMMARY OF THE INVENTION

The present invention is intended to provide a built-in sun-shading device of hollow glass capable of enabling balanced rolling-up and rolling-down, making a neat stack and preventing the sun-shading mechanism from dropping by itself.

In order to achieve aforesaid objective, the built-in sun-shading device of hollow glass provided by the present invention comprises a cord-winding mechanism, a transmission mechanism controlling the rotation of the cord-winding mechanism, and a sun-shading mechanism connected onto the cord-winding mechanism; the cord-winding mechanism comprises a cord-winding shaft having formed therein a plurality of shaft-wise grooves, a cord-winding propeller assembly arranged to engage with an end of the cord-winding shaft, wherein the cord-winding propeller assembly comprises a plurality of connection-guiding blocks designed to engage individually with each of the plurality of shaft-wise grooves on the cord-winding shaft and wherein the transmission mechanism is connected with the cord-winding shaft, and the sun-shading mechanism is fastened onto the cord-winding propeller assembly.

A group of shaft-wise grooves are arranged circumferentially around the cord-winding shaft, the cord-winding shaft being substantially circular in shape; and where the cord-winding propeller assembly further comprises a plurality of hoops arranged around the cord-winding shaft, wherein a ladder-cord fastening slot and a hoop fastening slot are arranged on at least one of the plurality of hoops; and a group of connection-guiding blocks are integrated into the hoops and match the grooves.

The connection-guiding blocks are tapered; the height of the end connecting with the hoop is greater than the depth of the groove, while the height of the other end is equal to or less than the depth of the groove.

The transmission mechanism comprises an upper pulley, a lower pulley, a belt, an inner handle and an outer handle; the upper pulley and the lower pulley are positioned by an upper pulley supporting stand and a lower pulley supporting stand; the two ends of the belt are discretely connected with the two ends of the inner handle so as to form a closed loop; the outer handle comprises a shell in which a group of roller mounting grooves are arranged; rollers are arranged inside the roller mounting grooves and are loosely connected to the shell; a group of magnets are arranged inside the shell.

The inner handle and the outer handle together form linkage under magnetic attraction.

The roller comprises a rolling body and rolling shafts positioned on two sides of the rolling body; rolling-shaft holes matching the rolling shafts are arranged on the shell, and the rolling-shaft holes are in a kidney shape.

The sun-shading mechanism comprises a group of slats or pleated slats; wherein the ladder-cords serially hold each slat and are connected with the cord-winding propeller assembly, pulling-cords are arranged at two ends of the slat, and the pulling cords are vertically intertwined onto the ladder-cords and one end of the pulling cords is fixed on the cord-winding shaft.

The ladder-cords comprise two sections of side cords that form a closed loop through connection, and a group of horizontal bars connecting these two sections of the pulling cords; the pulling cords and the horizontal bars are intertwined upward and are positioned restrictedly within the ladder-cords by the side cords.

The sun-shading mechanism further comprises blinds, pleated blinds or honeycomb blinds.

Owing to application of aforementioned technical solution, the present invention exhibits following advantages as compared to the prior art: the single cord-winding shaft used in the present invention is capable of winding a plurality of pulling cords, and this enables the sun-shading mechanism to have a balanced lifting and lowering; the single cord-winding shaft does not need to move back and forth, so the structure is simple and assembly thereof becomes more efficient. Meanwhile, the present invention makes use of the pulling cords which restricts the slats from moving back and forth such that the slats can stack up neatly, which therefore reduces contact with the hollow glass so as to protect the coating on the surface of the hollow glass and to reduce friction. Additionally, the present invention makes use of a single direction handle with frictional damping, which overcomes the defect of automatic fall happening to large-size sun-shading mechanism because of its large self-weight.

DETAILED DESCRIPTION OF THE INVENTION

The present invention provides a built-in sun-shading device of hollow glass comprising a cord-winding mechanism, a transmission mechanism controlling the rotation of cord-winding mechanism, and a sun-shading mechanism connected onto the cord-winding mechanism.

Figure 2:
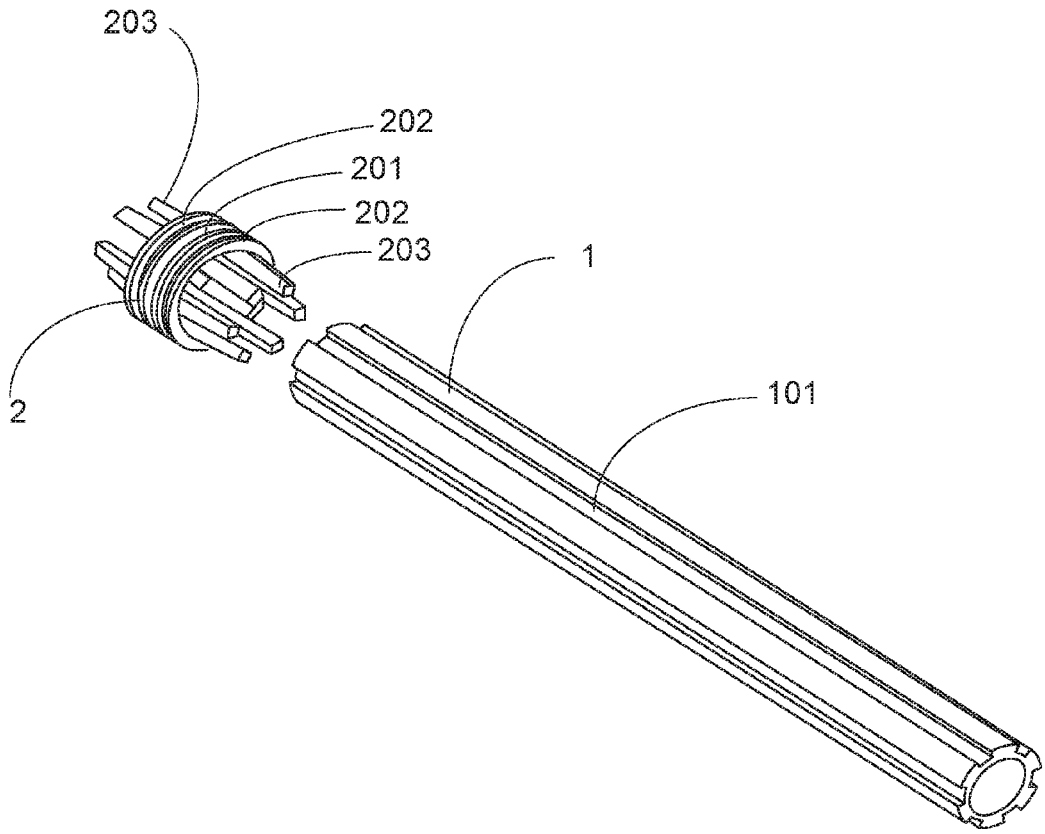
FIG. 2 illustrates a diagram of the structure of the cord-winding mechanism of the present invention.

As shown in FIG. 2, the cord-winding mechanism comprises a cord-winding shaft 1 and a cord-winding propeller assembly 2 arranged around the cord-winding shaft 1; a plurality of shaft-wise grooves 101 are arranged on the cord-winding shaft 1; the cord-winding propeller assembly 2 comprises a plurality of connection-guiding blocks 203 designed to engage individually with each of the plurality of shaft-wise grooves 101 on the cord-winding shaft 1 and where the cord-winding propeller assembly 2 further comprises hoops arranged around the cord-winding shaft 1, wherein a ladder-cord fastening slot 201 and a hoop fastening slot 202 are arranged on the hoop. The connection-guiding blocks 203 are tapered; the height of one end of the connection-guiding block is greater than the depth of the groove 101, and the height of the other end thereof is equal to or less than the depth of the groove 101.

Figure 3:
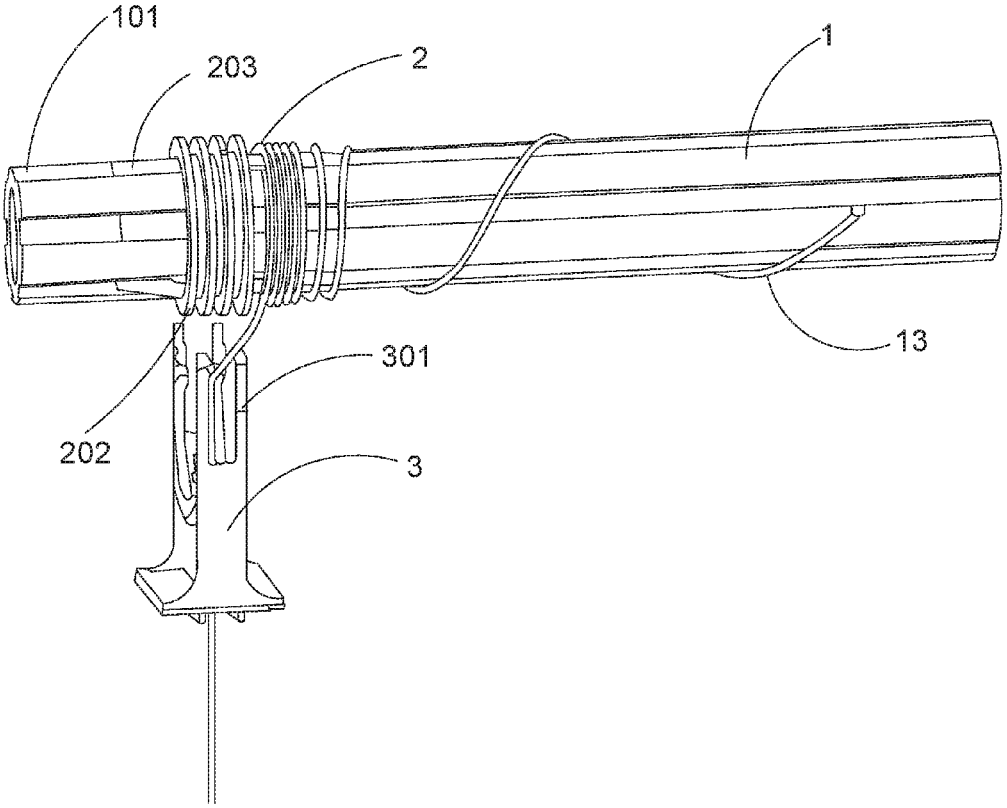
FIG. 3 illustrates a diagram of an assembly structure of the cord-winding mechanism of the present invention.
Figure 4:
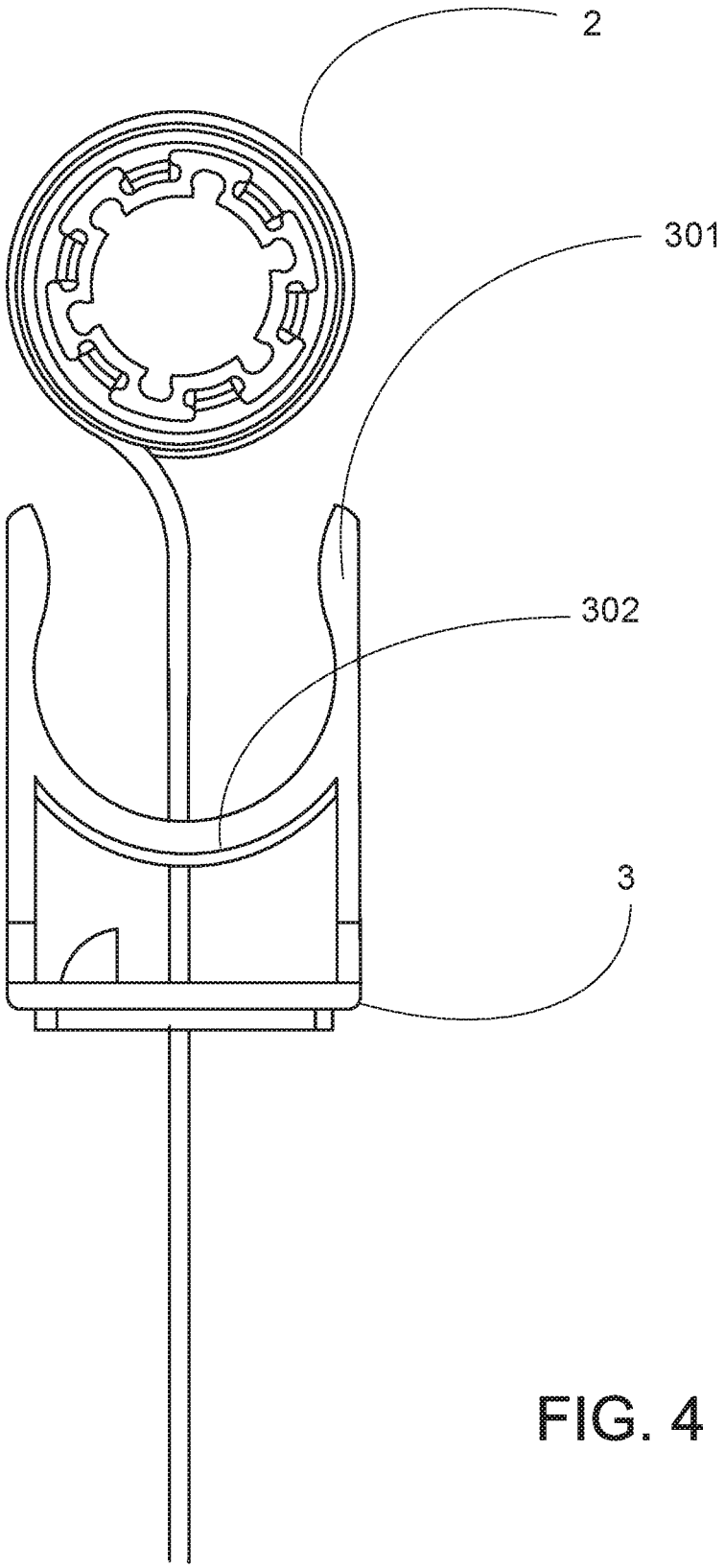
FIG. 4. illustrates a diagram of the structure of the cord-winding mechanism of the present invention.

As shown in FIG. 3 and FIG. 4, the cord-winding propeller assembly 2 is mounted around the cord-winding shaft 1, and the connection-guiding blocks are inserted into the grooves 101, such that the cord-winding propeller assembly 2 is positioned restrictedly on the cord-winding shaft 1 along the cord-winding propeller assembly's diametrical direction, at the meantime, the cord-winding propeller assembly 2 are jointly connected with a propeller-fastening stand 3, on which a joint block 301 corresponding to a joint slot and a base stand 302 for restricting the position of the cord-winding propeller assembly 2 is disposed. The propeller-fastening stand 3 is fastened into the upper bar (not shown), through which the propeller-fastening stand 3 is fastened onto the spacing bar 14 shown in FIG. 1.

Figure 1:
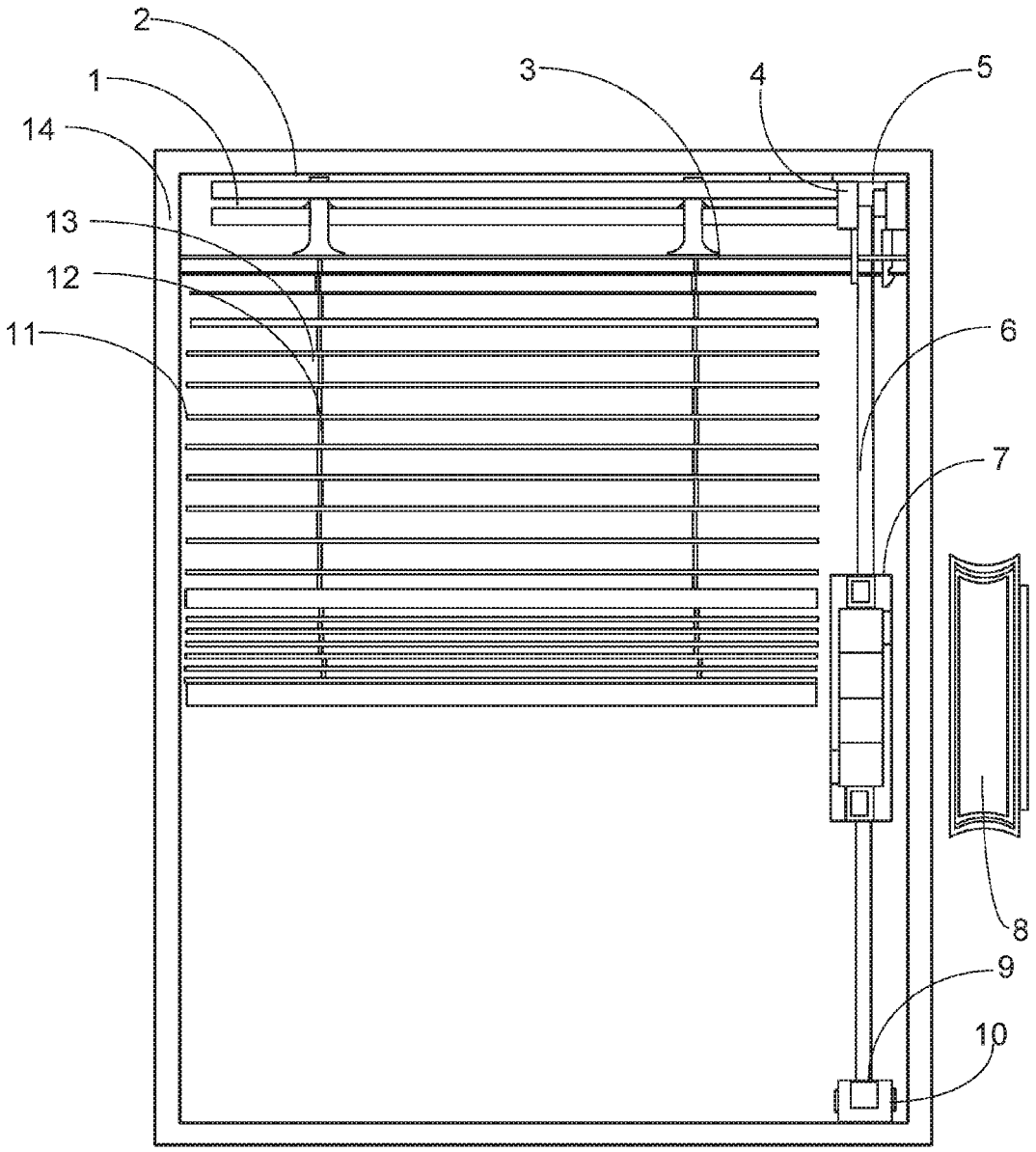
FIG. 1 illustrates a diagram of a structure of the present invention.
Figure 5:
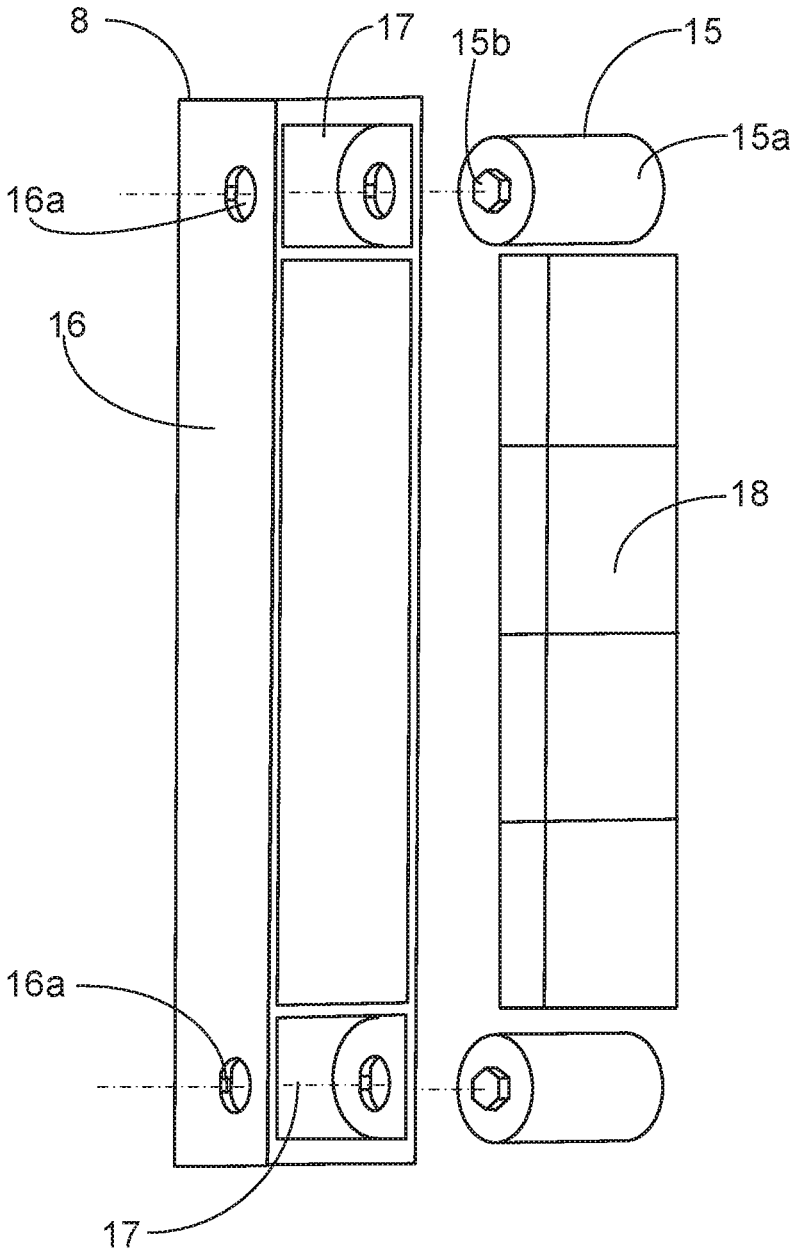
FIG. 5 illustrates a diagram of the structure of the outer handle of the present invention.

As shown in FIG. 1 and FIG. 5, the transmission mechanism is connected with the cord-winding shaft 1; the transmission mechanism comprises an upper pulley 5, a lower pulley 9, a belt 6, an inner handle 7 and an outer handle 8; the upper pulley 5 and the lower pulley 9 are discretely positioned by an upper pulley supporting stand 4 and a lower pulley supporting stand 10; the upper pulley supporting stand 4 and the lower pulley supporting stand 10 are discretely fastened on the upper section and the lower section of the spacing bar 14; the two ends of the belt 6 are connected respectively with the two ends of the inner handle 7 and form a closed loop; the inner handle 7 and the outer handle 8 form linkage under magnetic attraction; the outer handle 8 comprises a shell 16 in which a group of roller installing bearings 17 are arranged; the rollers 15 are arranged inside the roller installing bearings 17 and are loosely connected with the shell 16; and a group of magnets 18 are disposed inside the shell 16. The roller 15 comprises a rolling body 15*a* and rolling shafts 15*b* positioned on two sides of the rolling body 15*a*; rolling shaft holes 16*a* matching the rolling shafts 15*b* are disposed on the shell 16, and the rolling shaft holes 15*b* are in a kidney shape. When the outer handle 8 is operated to slide downward so as to stack up the slats 11, the rolling shafts 15*b* turn in a counter-clockwise direction and go upward till reaching the top of the rolling shaft holes 16; in this case, there is a gap between the rolling body 15*b* and the inner wall of the upper section of the roller mounting grooves 17, and this reduces friction and enables the operator to lift the pleated blind easily. When the outer handle 8 is lifted up, the rolling shafts 15*b* turn in a clockwise direction and go downward till reaching the bottom of the rolling-shaft holes 16*a*; in this case, the rolling shafts 15*b* can turn freely in the rolling-shaft holes 16*a*, while some friction arises because the rolling body 15*a* comes into contact with the inner wall of the lower section of the roller mounting grooves 17, therefore, the slats would not lower themselves automatically under the effect of its weight.

Figure 6:
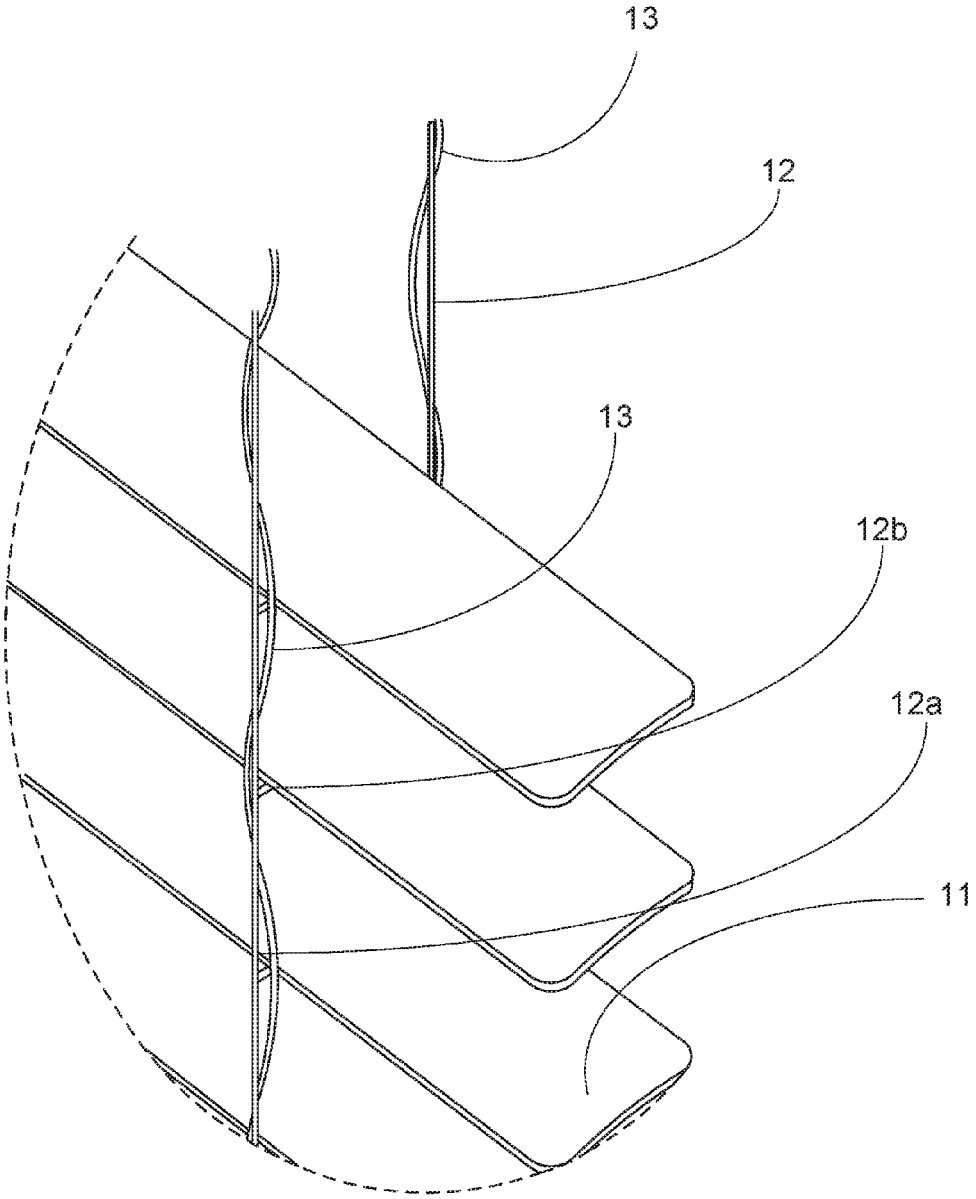
FIG. 6. illustrates a diagram of the structure of the pleated blinds of the present invention.

As shown in FIG. 3 and FIG. 6, the sun-shading mechanism comprises a group of slats, or even pleated slats, 11, ladder-cords 12 serially hold each slat 11 and are constrained in the ladder-cord fastening slot 201; pulling cords 13 are arranged on both sides of the slat 11, and the pulling cords are vertically intertwined onto the ladder-cords 12, while one end of the pulling cord 13 is fastened onto the cord-winding shaft 1. The ladder-cords 12 comprises two sections of side cords 12*a* forming a closed loop via connection and a group of horizontal bars 12*b* connecting these two sections of the side cords 12*a*; the pulling cords 13 and the horizontal bars 12*b* are intertwined upwards and are positioned restrictedly within the ladder-cords by the side cords 12*a*. The pulling cords 13 restricts the slats 11 from moving back and forth, such that the slats may stack up orderly, which therefore reduces contact with the hollow glass so as to protect the coating on the surface of the hollow glass and to reduce friction. In case of winding cords, since the connection-guiding blocks 203 are tapered, the pulling cord 13 wound earlier on the cord-winding shaft will be push out by the pulling cord wound later and will be wound orderly on the cord-winding shaft 1. However, it is necessary to clarify that only one pulling cord is exemplified in the drawings, while in practice two pulling cords are wound discretely on two sides of the cord-winding propeller assembly 2. Additionally, the sun-shading mechanism of the present invention may further adopt pleated blinds or honeycomb blinds.

The above embodiment is set out for the purpose of not limiting the scope of the present invention but merely illustrating the inventive idea and characteristics of the present invention with the objective of assisting those skilled people in the art to further their understanding and application of the present invention. Various alternations and modifications may be made without departing from the spirit and broader aspects of the present invention as set forth in the appended claims.

What is claimed is:

1. A built-in sun-shading device of hollow glass, which comprises a cord-winding mechanism, a transmission mechanism controlling rotation of the cord-winding mechanism, and a sun-shading mechanism connected onto the cord-winding mechanism, further comprising:

the cord-winding mechanism comprises a cord-winding shaft (1) having formed therein a plurality of shaft-wise grooves (101), a cord-winding propeller assembly (2) arranged to engage with an end of the cord-winding shaft (1), wherein the cord-winding propeller assembly (2) comprises a plurality of connection-guiding blocks (203) designed to engage individually with each of the plurality of shaft-wise grooves (101) on the cord-winding shaft (1) and wherein the transmission mechanism is connected with the cord-winding shaft (1), and the sun-shading mechanism is fastened onto the cord-winding propeller assembly (2).

2. The built-in sun-shading device of hollow glass in claim 1, which is further characterized in that:

the plurality of shaft-wise grooves (101) are arranged circumferentially around the cord-winding shaft (1), the cord-winding shaft (1) being substantially circular in shape, and where the cord-winding propeller assembly (2) further comprises a plurality of hoops arranged around the cord-winding shaft (1), wherein a ladder-cord fastening slot (201) and a hoop fastening slot (202) are arranged on at least one of the plurality of hoops, and a plurality of connection-guiding blocks (203) are integrated into the hoops and match the grooves (101).

3. The built-in sun-shading device of hollow glass in claim 2, which is further characterized in that:

the connection-guiding blocks (203) are tapered; the height of one end of each connection-guiding block is greater than the depth of a groove (101), and the height of the other end thereof is equal to or less than the depth of a groove (101).

4. The built-in sun-shading device of hollow glass in claim 1, which is further characterized in that:

the transmission mechanism comprises an upper pulley (5), a lower pulley (9), a belt (6), an inner handle (7) and an outer handle (8); the upper pulley (5) and the lower pulley (9) are positioned discretely by an upper pulley supporting stand (4) and a lower pulley supporting stand (10), respectively, the two ends of the belt (6) are connected discretely with the two ends of the inner handle (7) so as to form a closed loop; the outer handle (8) comprises a shell (16) in which a plurality of roller mounting grooves (17) are arranged; rollers (15) are arranged inside the roller mounting grooves (17) and are loosely connected to the shell (16), and a plurality of magnets (18) are arranged inside the shell (16).

5. The built-in sun-shading device of hollow glass in claim 4, which is further characterized in that:

the inner handle (7) and the outer handle (8) form a linkage under magnetic attraction.

6. The built-in sun-shading device of hollow glass in claim 4, which is further characterized in that:

the rollers (15) comprise a rolling body (15*a*), and rolling shafts (15*b*) positioned on two sides of the rolling body (15*a*), holes (16*a*) matching the rolling shafts (15*b*) are disposed on the shell (16), and the holes (16*a*) have a kidney shape.

7. The built-in sun-shading device of hollow glass in claim 1, which is further characterized in that:

the sun-shading mechanism comprises a group of slats (11), wherein the ladder-cords (12) serially hold the slats (11) and are connected with the cord-winding propeller assembly (2); pulling cords (13) are arranged at two ends of the slat (11), and the pulling cords (13) are vertically intertwined onto the ladder-cords (12), and one end of the pulling cords (13) is fixed on the cord-winding shaft (1).

8. The built-in sun-shading device of hollow glass in claim 7, which is further characterized in that:

the ladder-cords (12) comprise two sections of side cords (12*a*) forming a closed loop via connection, and a group of horizontal bars (12*b*) connecting the two side cords; the pulling cord (13) and the horizontal bars (12*b*) are intertwined upward and are positioned restrictedly within the ladder-cords (12) by the side cords (12*a*).

9. The built-in sun-shading device of hollow glass in claim 1, which is further characterized in that:

the sun-shading mechanism further comprises a pleated blind or a honeycomb blind.

* * * * *